US005244089A

United States Patent [19]

Yang et al.

[11] Patent Number: 5,244,089

[45] Date of Patent: Sep. 14, 1993

[54] PACKAGE FOR AN ELONGATE MEDICAL ARTICLE

[76] Inventors: Frank C. F. Yang; Judy C. C. Chen, both of 15th Fl., No. 243, An Ho Rd., Taipei, Taiwan

[21] Appl. No.: 901,135

[22] Filed: Jun. 19, 1992

Related U.S. Application Data

[63] Continuation-in-part of Ser. No. 693,617, Apr. 30, 1991, abandoned.

[51] Int. Cl.[5] ..... B65D 83/02

[52] U.S. Cl. ..... 206/361; 206/363; 206/469; 604/198

[58] Field of Search ..... 206/212, 306, 361, 363, 206/365, 367, 461, 469, 467, 471; 604/198, 203

[56] References Cited

U.S. PATENT DOCUMENTS

| | | | |
|---|---|---|---|
| 2,892,538 | 6/1959 | Middleton, Jr. et al. | 206/469 X |
| 3,056,493 | 10/1962 | Berryman et al. | 206/484 X |
| 3,086,647 | 4/1963 | Krezanoski | 206/484 X |
| 3,270,878 | 9/1966 | Giesler | 206/484 |
| 3,338,400 | 8/1967 | Edgworth et al. | 206/484 X |
| 3,759,375 | 9/1973 | Nappi | 206/361 X |
| 3,835,990 | 9/1974 | Sagi et al. | 206/306 |
| 3,910,410 | 10/1975 | Shaw | 206/363 |
| 3,968,876 | 7/1976 | Brookfield | 206/365 |
| 4,106,621 | 8/1978 | Sorenson | 206/365 |
| 4,324,331 | 4/1982 | Ignasiak | 206/363 |
| 4,966,591 | 10/1990 | Yuen | 604/192 |

FOREIGN PATENT DOCUMENTS

| | | | |
|---|---|---|---|
| 1474882 | 3/1967 | France | 206/365 |

*Primary Examiner*—Bryon P. Gehman
*Attorney, Agent, or Firm*—Staas & Halsey

[57] ABSTRACT

A package for an elongate medical article including a lower plastic sheet and a upper plastic casing with the upper casing forming a convex packaging space for containing an elongate medical article therein, where the upper casing is sealed and bonded with the lower sheet along a periphery of the convex space. The feature of the package lies in the convex space which is separated into front and rear parts by a strongly bonded portion at such a position that a head portion of the contained article is contained in the front part, and a tail portion of the contained article is contained in the rear part of the convex space, allowing a user to manipulate the article without contacting any part of this body.

4 Claims, 4 Drawing Sheets

PACKAGE FOR AN ELONGATE MEDICAL ARTICLE

This application is a continuation-in-part application of U.S. patent application Ser. No. 07/693,617, filed on Apr. 30, 1991 which is now abandoned.

BACKGROUND OF THE INVENTION

The present invention relates to a package for an elongate medical article such as a needle-shaped article or a rod-shaped article that can be made economically, carried conveniently, and can assure sterilization.

Various types of needle-shaped articles such as acupuncture needles, injection needles, etc, and rod-shaped articles such as swabs, are commonly used in hospitals, clinical laboratories, and many other places where needles are packaged in a structure consisting of a plurality of packaging spaces, each containing a single needle, arranged in a matrix, or are individually packaged in single encapsulators as shown in FIGS. 5 and 6.

However, in order to prevent a needle or rod from vibrating during transportation, which may cause the needle to puncture through the packaging material and injure the user, or cause the needle to fall off through the broken space of the packaging material, subsequently injuring other innocent people, conventional forms of packaging either vacuum package the needle so that it firmly clings to the upper or lower portion of the packaging bodies, or reinforce the hardness and resilience of the packaging material at the tail or rear portion of the needle so that the sharp tail end may not puncture through the packaging material.

Such forms of packaging are inconvenient and cumbersome, in that the user has to tear open the main body of the package in order to access the needle, and, in so doing, may use so much force that the recoil causes the needle to fall to the ground after opening, subjecting it to contamination or, conversely so little force that the package is unable to be opened.

The package can also be used to house cotton swabs, which are commonly used by related fields, such as oralogy, otorhinology, obstetrics, and gynecology, so as to prevent contamination from bacteria, viruses, etc, and in electronics to insure a dust free environment.

In view of the drawbacks of conventional packages for needle-shaped and rod-shaped articles which provide a plurality of packaging spaces arranged in a matrix, but produce some problems in drawing out or using the contained needles, the present invention solves the problems heretofore commonly existing in conventional packaging structures for a needle.

It is the purpose of this present invention, therefore, to mitigate and/or obviate the above-mentioned drawback in the manner set forth in the detailed description of the preferred embodiment.

SUMMARY OF THE INVENTION

Accordingly, it is an object of this invention to provide a package for an elongate medical article such as a needle-shaped article or a rod-shaped article which allows convenient access to the contained needle and prevents the needle from contamination by bacteria, viruses, and other medical contaminants encountered when drawing out the needle, and also to prevent decay of the needle due to moisture during storage.

Another object of this invention is to provide a package for an elongate medical article such as a needle-shaped article or a rod-shaped article which can be produced economically.

A further object of this invention is to provide a package for an elongate medical article such as a needle-shaped article or a rod-shaped article in which the partially peeled package can be incorporated into the process of the treatment, acting as a barrier to an infectious source, thereby preventing operators from being contaminated by the viruses or bacteria of patients and also preventing the medical article from being contaminated by users.

Further objects and advantages of the present invention will become apparent as the following description proceeds, and the features of novelty which characterize the invention will be pointed out in the claims annexed to and forming a part of this application.

DETAILED DESCRIPTION OF THE PREFERRED EMBODIMENTS

Figure 1:
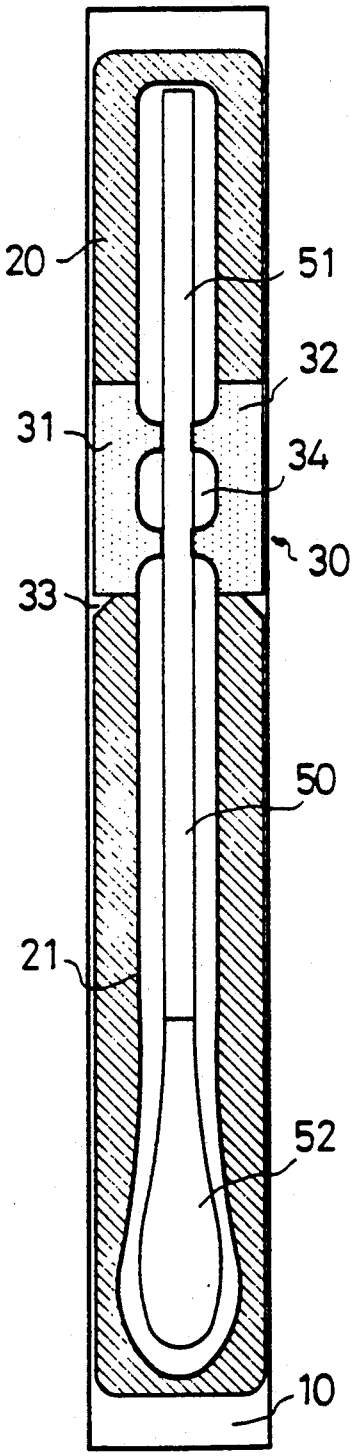
FIG. 1 is a schematic view of a package according to the present invention for packaging swabs.

FIG. 1 illustrates a package housing a rod-shaped article (swab) 50 consisting of a rod-shaped body 51 and a head 52. The package comprises an upper plastic casing 20 above a lower plastic sheet 10 with a mediate portion therebetween being provided with an adhesive 30 to isolate the rod-shaped body 51 and the head 52.

Figure 4:
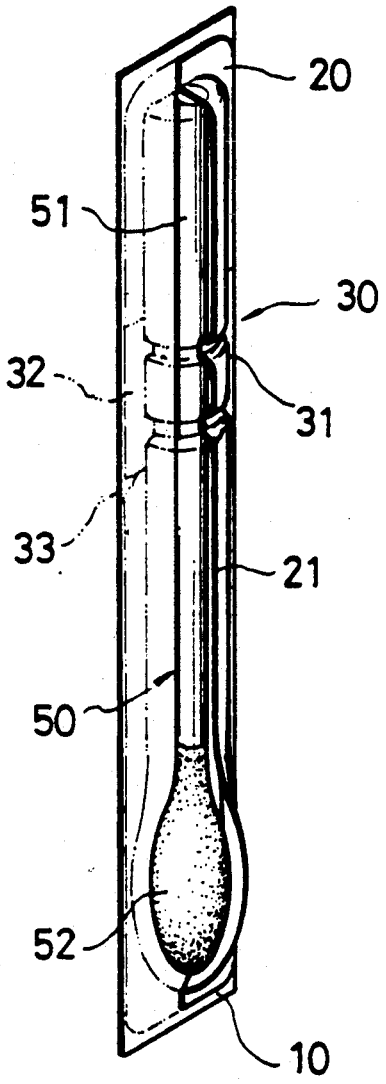
FIG. 4 is a reduced scale of a partial cross-sectional view of a package according to the present invention for packaging swabs.
Figure 5:
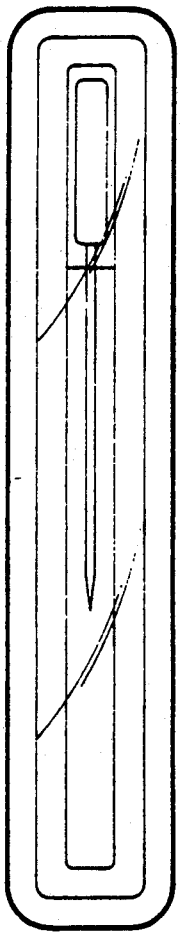
FIG. 5 PRIOR ART
FIG. 5 is a schematic view of a conventional package for an acupuncture needle according to prior art.
Figure 6:
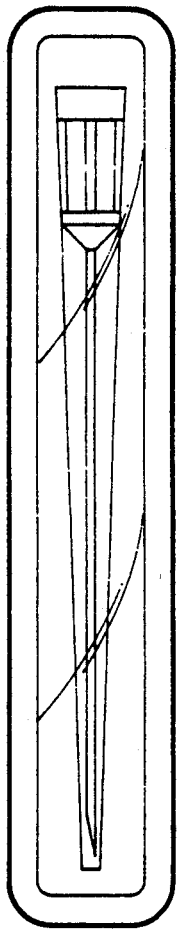
FIG. 6 PRIOR ART
FIG. 6 is a schematic view of a conventional package for an injection needle according to prior art.

In FIG. 4, the upper plastic casing 20 forms one convex packaging space 21 and is releasably bonded with the lower plastic sheet 10, thereby forming a containing space for swabs. Between the upper plastic casing 20 and lower plastic sheet 10, a gap 33 is provided on both sides of the adhesive 30, thereby allowing the user to partially peel the upper casing 20 with ease. The releasable bonding of the upper plastic casing 20 to the lower plastic sheet 10 by an adhesive is well-known to one of ordinary skill in this art.

Figure 7:
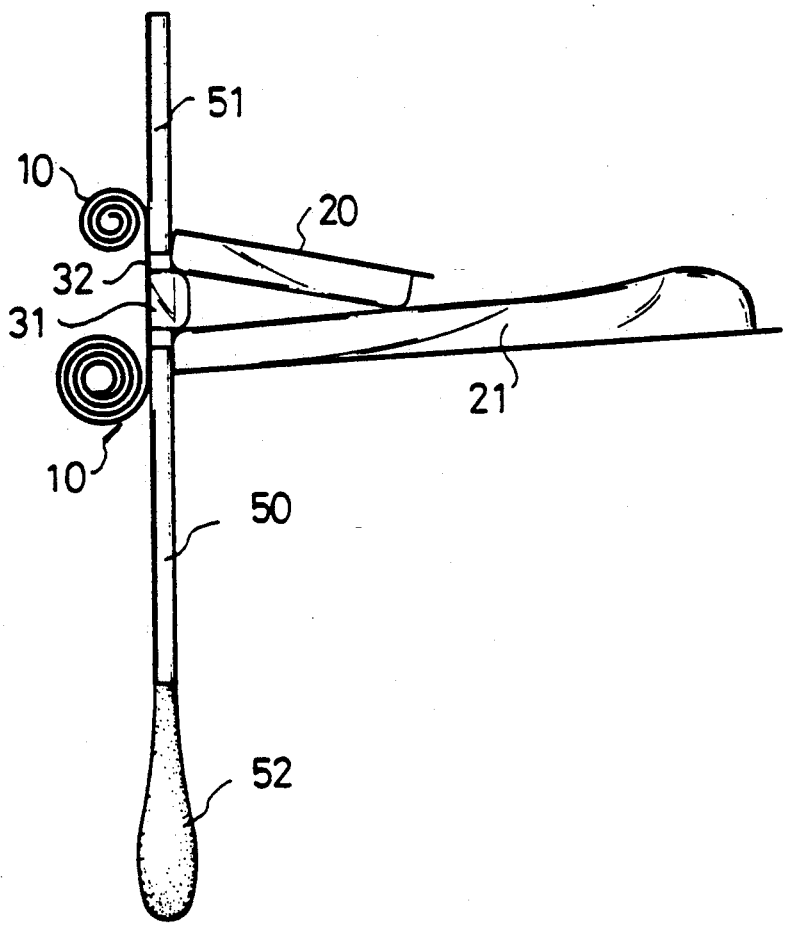
FIG. 7 is an isometric view relative to FIG. 4 in which the top and bottom portions of the lower plastic sheet are partially peeled from the upper plastic casing forming a rolled-up configuration and the top and bottom portions of the upper plastic casing are bent.

Referring to FIG. 7, the partially peeled lower plastic sheet 10 forming a rolled-up configuration and the bent portions of the upper plastic casing 20 give the user access at one end whilst exposing the head 52 at the other end, providing an effective configuration for protecting users from contamination by viruses and bacteria that may be transmitted from patients via the swab in the process of treatment, i.e., the overall package is incorporated into the medical process, which is a novel and creative idea over the relevant prior art.

Figure 2:
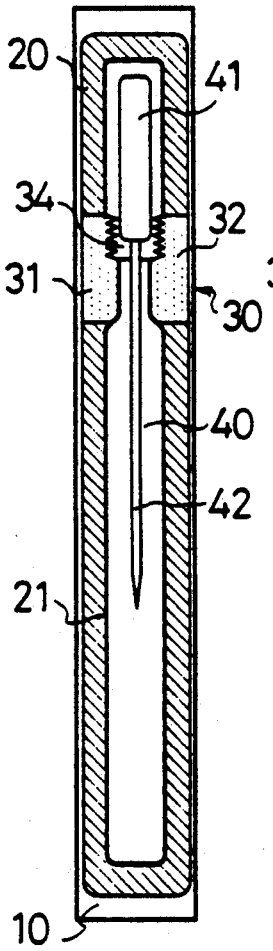
FIG. 2 is a schematic view of a package according to the present invention for packaging acupuncture needles, and is an isometric view relative to FIG. 1, in which the central passage has a serrated portion.
Figure 3:
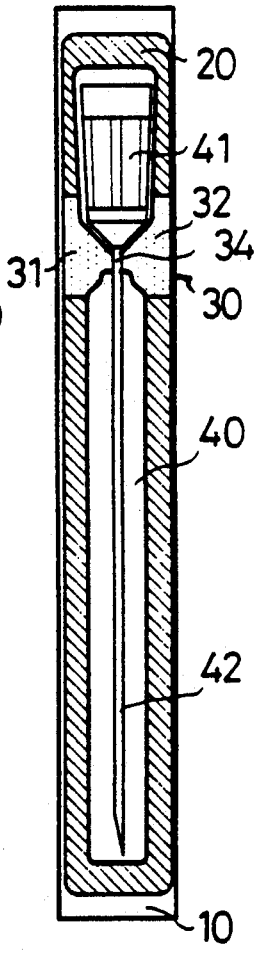
FIG. 3 is a schematic view of a package according to the present invention for packaging injection needles, and is an isometric view relative to FIG. 1.

In FIGS. 2 and 3, a needle-shaped article 40 having a handle end 41 for gripping, and an elongate needle end 42, is shown. The upper plastic casing 20 forms a convex packaging space 21 and is bonded with the lower plastic sheet 10 along the periphery of the convex packaging space 21, thereby forming a containing space for the needle-shaped article. In the convex packaging space 21 between the handle end 41 and the elongate needle end 42 lies an adhesive 30 which separates the convex packaging space 21 into a top and bottom part, allowing the upper plastic casing 20 and lower plastic sheet 10 to be torn apart to expose the needle contained therein.

Referring to FIG. 2, in acupuncture needle manipulation, the acupuncturist partially peels the lower plastic sheet 10 from the upper casing 20 forming a rolled-up configuration similar to the diagram shown in FIG. 7. To prevent the user from being infected by patients, the acupuncturist holds the needle with one hand at the adhesive 30 and holds the handle end 41 with the other hand to insert, draw, or twirl the needle in an acupoint in the body in order to achieve the chi acquisition effect. In the process of acquisition, the needle 40 is passed through a central passage 34 having a serrated portion to facilitate correct gripping of the handle end 41, thereby allowing the acupuncturist to perform and accomplish needling without touching the elongate needle portion 42.

In FIG. 3, the user may partially peel the top portion of the lower plastic sheet 10 from the upper plastic casing 20 forming a rolled-up configuration similar to the top portion of the illustration shown in FIG. 7. The needle to syringe assembly can then be accomplished by holding the adhesive 30 with one hand and pushing the handle end 41 of the injection needle 40 onto the needle-receiving protrusion of a syringe. The partially peeled lower plastic sheet 10 at the bottom part of the package exposes the needle end, since the user hand never touches the needle, contamination is prevented. A central passage 34 having a shape complimentary to that of a junction of the handle end 41 and elongate needle end 42 is provided along a longitudinal axis of the adhesive 30.

The adhesive 30 can be formed by thermosealing the upper plastic casing 20 and the lower plastic sheet 10 on two opposite sides of the containing space to produce thermosealed zones 31 and 32 that are difficult to tear apart. The thermosealed zones 31 and 32 firmly brace the needle 40 along a periphery thereof, and form a narrow passage 34 of an appropriate dimension so as to provide a passage for the elongate needle portion 42 in position. The adhesive 30 can also be formed by gluing a mediate section of the convex packaging space 1, while other portions of the upper plastic casing 20 and lower plastic sheet 10 in the top and bottom parts are glued with an adhesive of relatively weaker bonding strength.

Accordingly, the present invention provides an innovative package for an elongate medical article such as a needle-shaped article which, with the package itself acting as a barrier between the user and the infectious source in the medical process, can prevent the needle from contamination by bacteria, viruses, and other medical contaminants encountered during drawing and use of the needle, or prevent decay of the needle due to moisture during storage.

While the present invention has been explained in relation to its preferred embodiments, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A package for an elongate medical article, including two ends, a lower plastic sheet and an upper plastic casing, said upper plastic casing having a convex packaging space and releasably bonding, via a first adhesive layer between the lower plastic sheet and the upper plastic casing, with said lower plastic sheet along a portion of a periphery of said convex packaging space for containing an elongate medical article, the improvement comprising:

a second adhesive layer provided between said upper plastic casing and said lower plastic sheet at a mediate portion of said upper plastic casing and lower plastic sheet, said second adhesive layer being a stronger adhesive than the first adhesive layer for providing a strongly bonded mediate portion, said second adhesive layer defining with said convex packaging space a central passage extending along said convex packaging space of said package allowing said elongate medical article to pass through said central passage, said central passage being shaped to hold said elongate medical article securely, said lower plastic sheet being partially peeled away from said upper plastic casing at both ends of said package to adjacent portions of said second adhesive layer, top and bottom portions of said upper plastic casing being partially bendable so as to protect users of the elongate medical article from being infected.

2. A package for an elongate medical article according to claim 1, wherein said elongate medical article is a needle-shaped article having a handle end and an elongate needle end, said central passage having a serrated portion for holding said handle end.

3. A package for an elongate medical article according to claim 1, wherein said elongate medical article is a needle-shaped article having a handle end and an elongate needle end, said central passage having a shape complimentary to that of a junction of said handle end and said elongate needle end.

4. A package for an elongate medical article according to claim 1, wherein elongate medical said article is a swab.

* * * * *